US006637979B2

(12) United States Patent
Finn et al.

(10) Patent No.: US 6,637,979 B2
(45) Date of Patent: Oct. 28, 2003

(54) TELESCOPING TRUSS PLATFORM

(75) Inventors: Lyle D. Finn, Sugarland, TX (US); J. Lynn LeJune, Houston, TX (US)

(73) Assignee: CSO Aker Maritime, Inc., Houston, TX (US)

( * ) Notice: Subject to any disclaimer, the term of this patent is extended or adjusted under 35 U.S.C. 154(b) by 82 days.

(21) Appl. No.: 09/946,951

(22) Filed: Sep. 4, 2001

(65) Prior Publication Data

US 2003/0044239 A1 Mar. 6, 2003

(51) Int. Cl.[7] ..... E02D 15/02
(52) U.S. Cl. ..... 405/224.2
(58) Field of Search ..... 405/200, 224.2, 405/224.3, 224.4, 203, 205; 114/264, 265, 266

(56) References Cited

U.S. PATENT DOCUMENTS

| | | | | |
|---|---|---|---|---|
| 2,558,344 A | | 6/1951 | De Giers | |
| 3,001,370 A | * | 9/1961 | Templeton | 405/200 |
| 3,277,653 A | * | 10/1966 | Foster | 405/200 |
| 4,007,598 A | * | 2/1977 | Tax | 405/200 |
| 4,702,321 A | | 10/1987 | Horton | |
| 4,740,109 A | | 4/1988 | Horton | |
| 5,558,467 A | | 9/1996 | Horton | |
| 5,823,131 A | | 10/1998 | Boatman et al. | |
| 6,375,391 B1 | * | 4/2002 | Borseth et al. | 405/211 |

FOREIGN PATENT DOCUMENTS

| | | |
|---|---|---|
| GB | 2147549 A | 5/1985 |
| WO | WO 0058598 | 10/2000 |
| WO | WO 00/63519 | 10/2000 |

* cited by examiner

*Primary Examiner*—Michael Safavi
(74) *Attorney, Agent, or Firm*—Klein, O'Neill & Singh, LLP

(57) ABSTRACT

A semisubmersible floating platform for use in marine environments. The platform comprises a truss telescopingly mounted to the platform and movable between upper and lower positions with respect to the platform. At least one riser buoyancy member is telescopingly mounted to the platform and movable between upper and lower positions with respect to the platform. For each riser buoyancy member, at least one guide is attached to the truss and adjacent the buoyancy member for guiding and laterally restraining the buoyancy member.

6 Claims, 6 Drawing Sheets

TELESCOPING TRUSS PLATFORM

CROSS-REFERENCE TO RELATED APPLICATIONS

Not Applicable.

STATEMENT REGARDING FEDERALLY SPONSORED RESEARCH AND DEVELOPMENT

Not applicable.

BACKGROUND OF THE INVENTION

1. Field of the Invention

The present invention relates to floating platforms used in the exploration and production of offshore minerals, and, more particularly, to a semisubmersible floating platform having a truss and air cans telescopingly mounted to the platform and movable between upper and lower positions with respect to the platform.

2. Description of the Prior Art

Prior floating platforms used in the exploration and production of offshore minerals are described in U.S. Pat. No. 4,702,321 to Edward E. Horton for "Drilling, Production, and Oil Storage Caisson for Deep Water," U.S. Pat. No. 4,740,109 to Edward E. Horton for "Multiple Tendon Compliant Tower Construction," and U.S. Pat. No. 5,558,467 to Edward E. Horton for "Deep Water Offshore Apparatus."

A system with a guide frame for petroleum production risers is disclosed in PCT International Publication No. WO 00/58598 (Application No. PCT/NO 00/00106). A satellite separator platform is disclosed in PCT International Publication No. WO 00/63519 (Application No. PCT/US 00/10936).

BRIEF SUMMARY OF THE INVENTION

The present invention provides a method of installation of a floating platform at a production location. The platform has a truss and riser buoyancy members telescopingly mounted therein. The riser buoyancy members are laterally restrained by guides attached to the truss. The method comprises towing the platform to the production location at a relatively shallow, towing depth with the truss and riser buoyancy members in a raised position within the platform. The method further comprises lowering the truss telescopingly to a lowered position extending below the platform. At least some of the guides laterally restrain the riser buoyancy members throughout the lowering process. The method further comprises lowering the riser buoyancy members telescopingly into the lowered truss. At least some of the guides laterally restrain the riser buoyancy members throughout this lowering process as well. The method further comprises installing risers through the riser buoyancy members for connection to wells on the sea floor.

According to a second aspect of the invention, a semisubmersible floating platform for use in marine environments is provided. The platform comprises a truss telescopingly mounted to the platform and movable between upper and lower positions with respect to the platform. At least one riser buoyancy member is telescopingly mounted to the platform and movable between upper and lower positions with respect to the platform. For each riser buoyancy member, at least one guide is attached to the truss and adjacent the buoyancy member for guiding and laterally restraining the buoyancy member.

According to a third aspect of the invention, a semisubmersible floating platform for use in marine environments is provided. The platform comprises a buoyant hull and a deck mounted to the hull. A truss is telescopingly mounted within the hull and movable between upper and lower positions with respect to the platform. A plurality of air cans are telescopingly mounted within the hull and movable between upper and lower positions with respect to the platform. The air cans are substantially caged by the truss when the truss and the air cans are in their raised and in their lowered positions with respect to the platform. The air cans are adapted to receive risers therethrough for providing buoyancy to the risers. For each air can, at least one guide is attached to the truss and adjacent the air can for guiding and laterally restraining the air can.

BRIEF DESCRIPTION OF THE SEVERAL VIEWS OF THE DRAWING

For a more complete understanding of the present invention, and the advantages thereof, reference is now made to the following Detailed Description of Example Embodiments of the Invention taken in conjunction with the accompanying drawings, in which.

DETAILED DESCRIPTION OF AN EXAMPLE EMBODIMENT OF THE INVENTION

Figure 1:
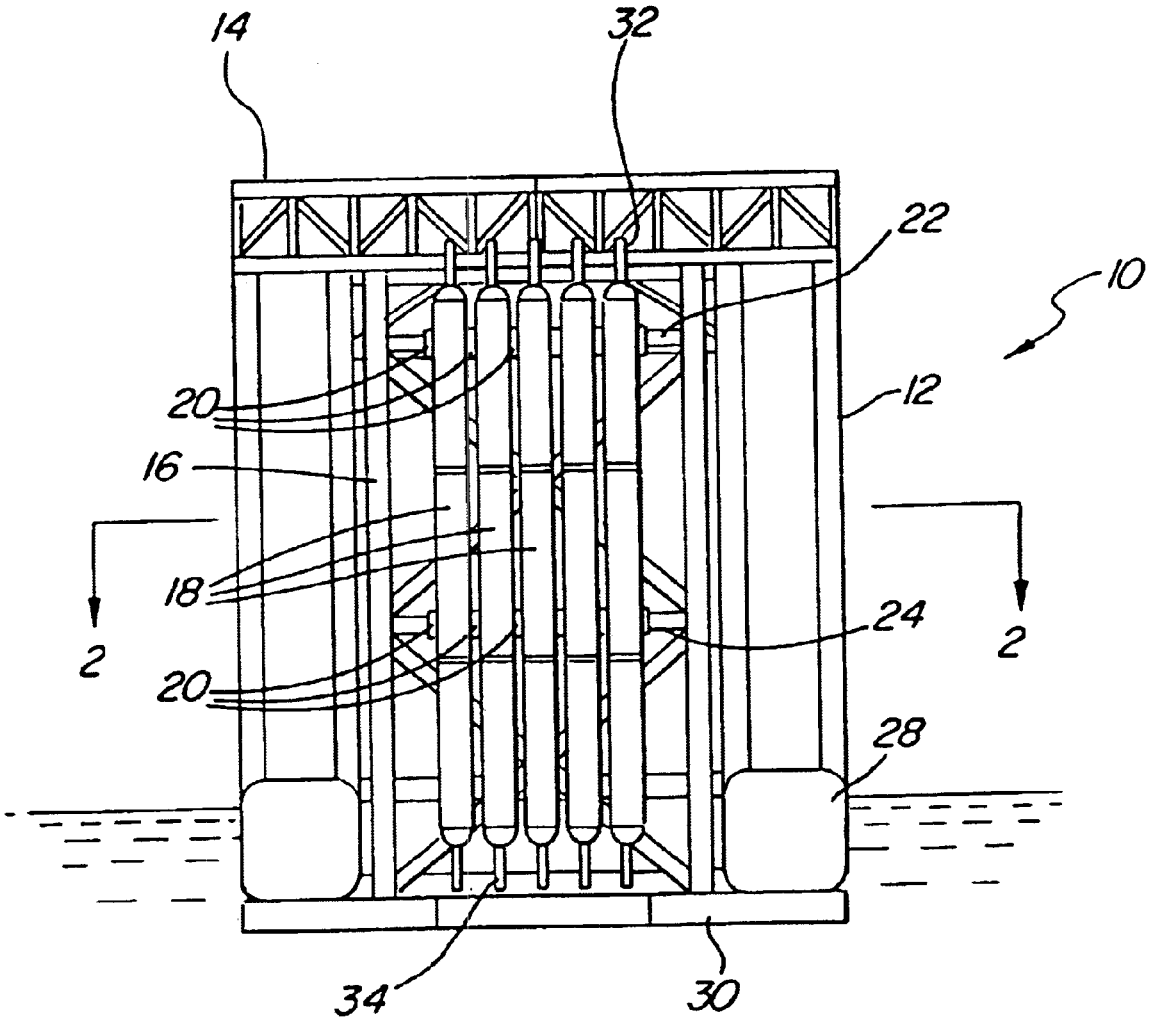
FIG. 1 is a side elevation view of a telescoping truss platform according to an example embodiment of the present invention, in which the telescoping truss and the air cans are in their raised positions within the well of the hull.

The present invention and its advantages are best understood by referring to the drawings, like numerals being used for like and corresponding parts of the various drawings.

FIG. 1 illustrates a semisubmersible floating platform, generally designated 10, for use in marine environments for exploration and production of offshore minerals. Floating platform 10 comprises a buoyant hull 12, a deck 14 mounted to hull 12, and a truss 16 telescopingly mounted within hull 12 and movable between upper and lower positions with respect to platform 10. A plurality of riser buoyancy members or air cans 18 are telescopingly mounted within hull 12. Air cans 18 are movable between upper and lower positions with respect to platform 10. The air cans 18 are substantially enclosed or "caged" by truss 16 when truss 16 and air cans 18 are in their raised and in their lowered positions with respect to platform 10. Air cans 18 include upper stems 32 and lower stems 34.

A heave plate 30 is attached to the lower end of truss 16 for suppressing heave and vertical motions of platform 10 when truss 16 is in its lowered position with respect to platform 10. Heave plate 30 and its advantages are more fully described in U.S. patent application Ser. No. 09/686,535, filed Oct. 10, 2000, and entitled "Heave Suppressed Offshore Drilling and Production Platform," which application is attached hereto as Appendix A. Appendix A is incorporated herein by reference.

For each air can 18, at least one compliant guide 20 is attached to truss 16 and adjacent the air can 18 for guiding, and laterally restraining the air can 18 as it moves between its upper and lower positions. Guides 20 are compliant for protecting air cans 18 and truss 16 from impact damage from environmental forces acting on air cans 18 and platform 10. Compliant guides 20 are more fully described in U.S. patent application Ser. No. 09/850,599, filed Apr. 11, 2001, and entitled "Compliant Buoyancy Can Guide," which application is attached hereto as Appendix B. Appendix B is incorporated herein by reference.

In the embodiment illustrated in FIG. 1, truss 16 includes upper lateral members 22 and middle lateral members 24. In the illustrated embodiment, compliant guides 20 are installed on both upper lateral members 22 and on middle lateral members 24 of truss 16. In an alternative embodiment, compliant guides 20 are also installed on lower lateral members near the bottom of truss 16 (not illustrated). Buoyant hull 12 includes hollow pontoons 28 that are capable of being filled with sea water for adjusting the buoyancy of platform 10.

Figure 2:
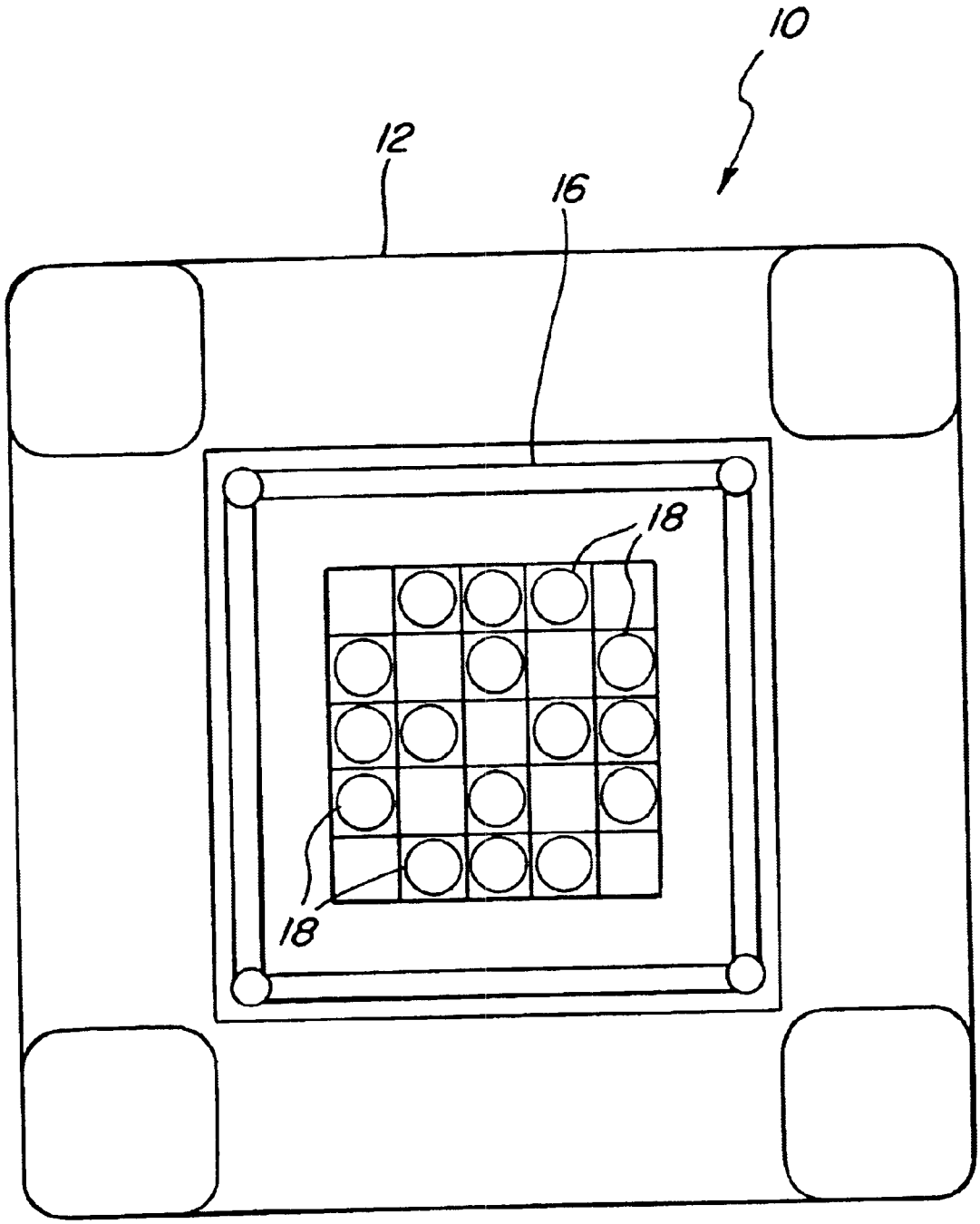
FIG. 2 is a cross-sectional, plan view of the platform of FIG. 1, taken along line 2—2 in FIG. 1.

FIG. 2 is a plan, cross-sectional view taken along line 2—2 in FIG. 1. Compliant guides 20 and heave plate 30 are not shown in FIG. 2.

This invention also relates to a method of installation of floating platform 10 at an offshore drilling or production location. The method of installation is illustrated in FIGS. 1–5. First, platform 10 is assembled onshore by building hull 12 having hollow pontoons 28 at its bottom. Movable truss 16 having compliant guides 20 and heave plate 30 thereon is then fitted within the well of platform 10. Movable air cans 18 are then fitted within compliant guides 20 of truss 16, and are substantially caged by truss 16. Finally, deck 14 is installed onto the top of hull 12, completing the construction of platform 10.

As seen in FIG. 1, platform 10 is then launched offshore and towed to the production site ballasted to the indicated mean water level (MWL). Because truss 16 and air cans 18 are initially in their raised positions within the well of hull 12, platform 10 can be launched and floated out at a relatively shallow, towing depth in relatively shallow water. While being towed, hollow pontoons 28 are relatively empty of sea water for minimizing the draft of platform 10 and for improving its stability during tow.

Figure 3:
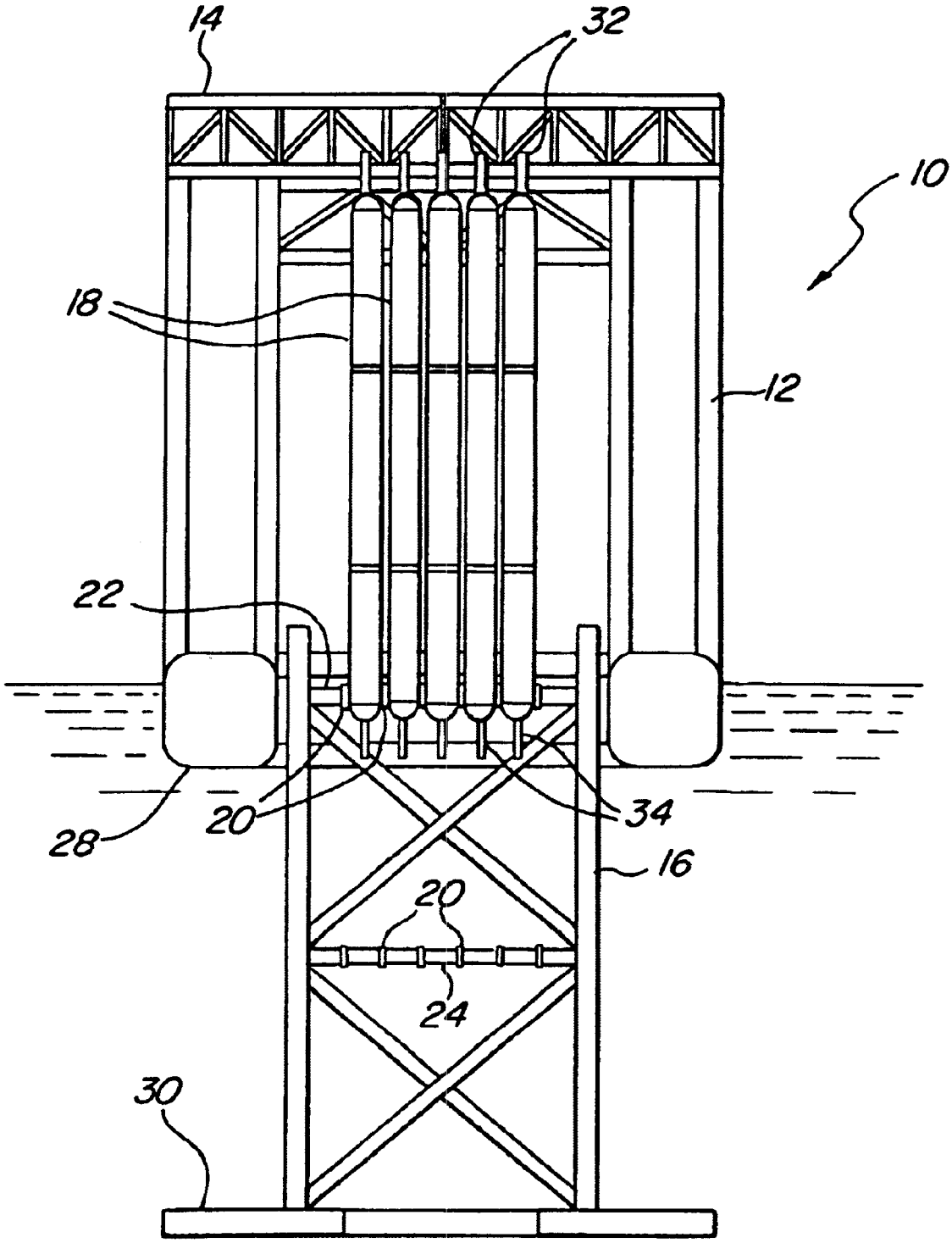
FIG. 3 is a side elevation view of the platform of FIG. 1, with the truss in its lowered position.

After platform 10 has been towed to the selected deep water production or drilling site, truss 16 is lowered to the position shown in FIG. 3. In the lowered position, truss 16 telescopingly extends out from and below platform 10, and heave plate 30 is positioned substantially below platform 10. This process is more fully described in more fully described in U.S. patent application Ser. No. 09/686,535, filed Oct. 10, 2000, entitled "Heave Suppressed Offshore Drilling and Production Platform," incorporated herein by reference. When truss 16 is fully lowered, air cans 18 are supported vertically and laterally at their upper ends by deck 14 and at their lower ends by compliant guides 20 on upper lateral member 22 of truss 16. At this point, air cans 16 are still held substantially above the water surface, and are therefore not subject to wave or sea current forces. Therefore additional lateral support of air cans 18 is not needed.

Figure 4:
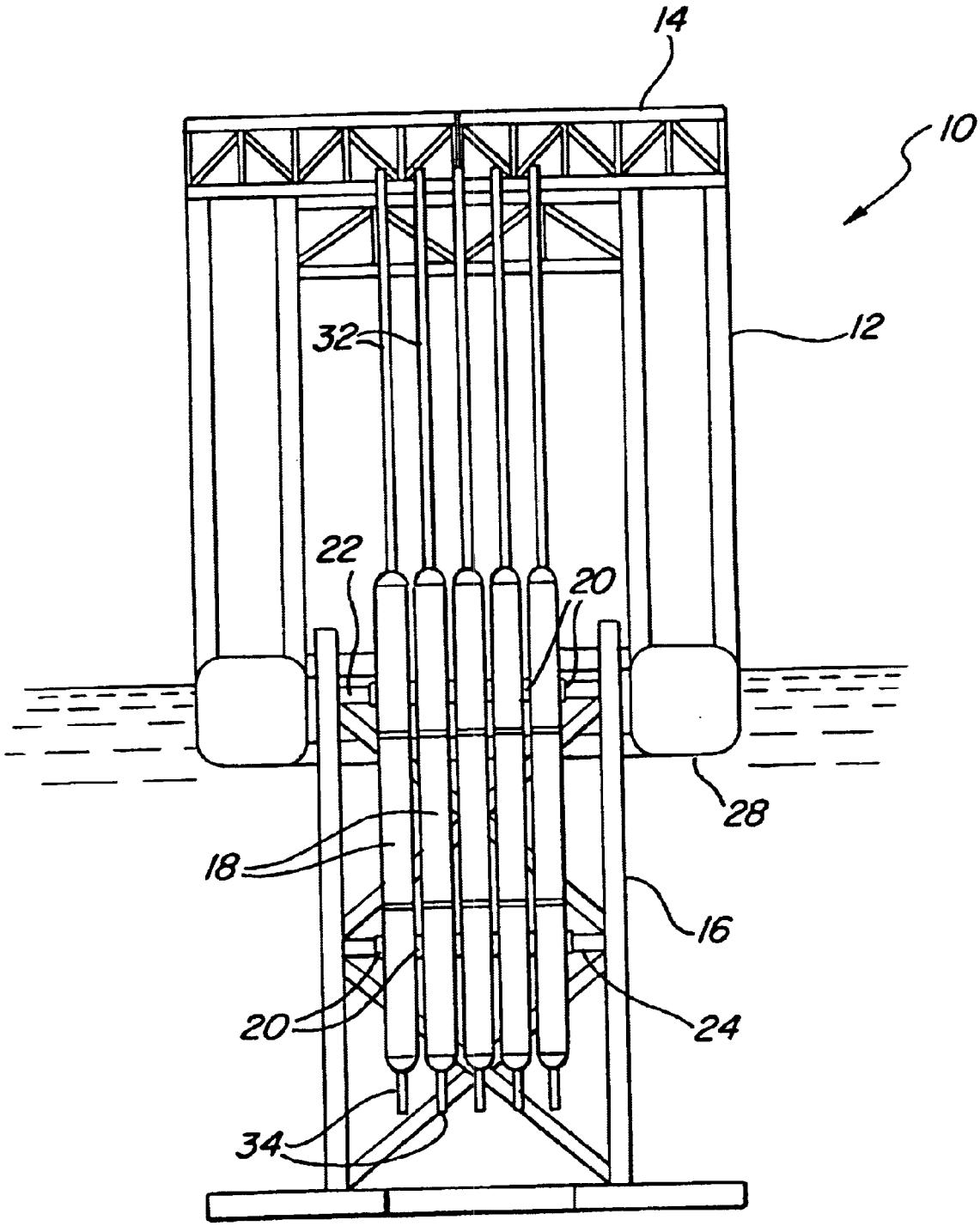
FIG. 4 is a side elevation view of the platform of FIG. 1, with the truss and the air cans in their lowered positions.
Figure 5:
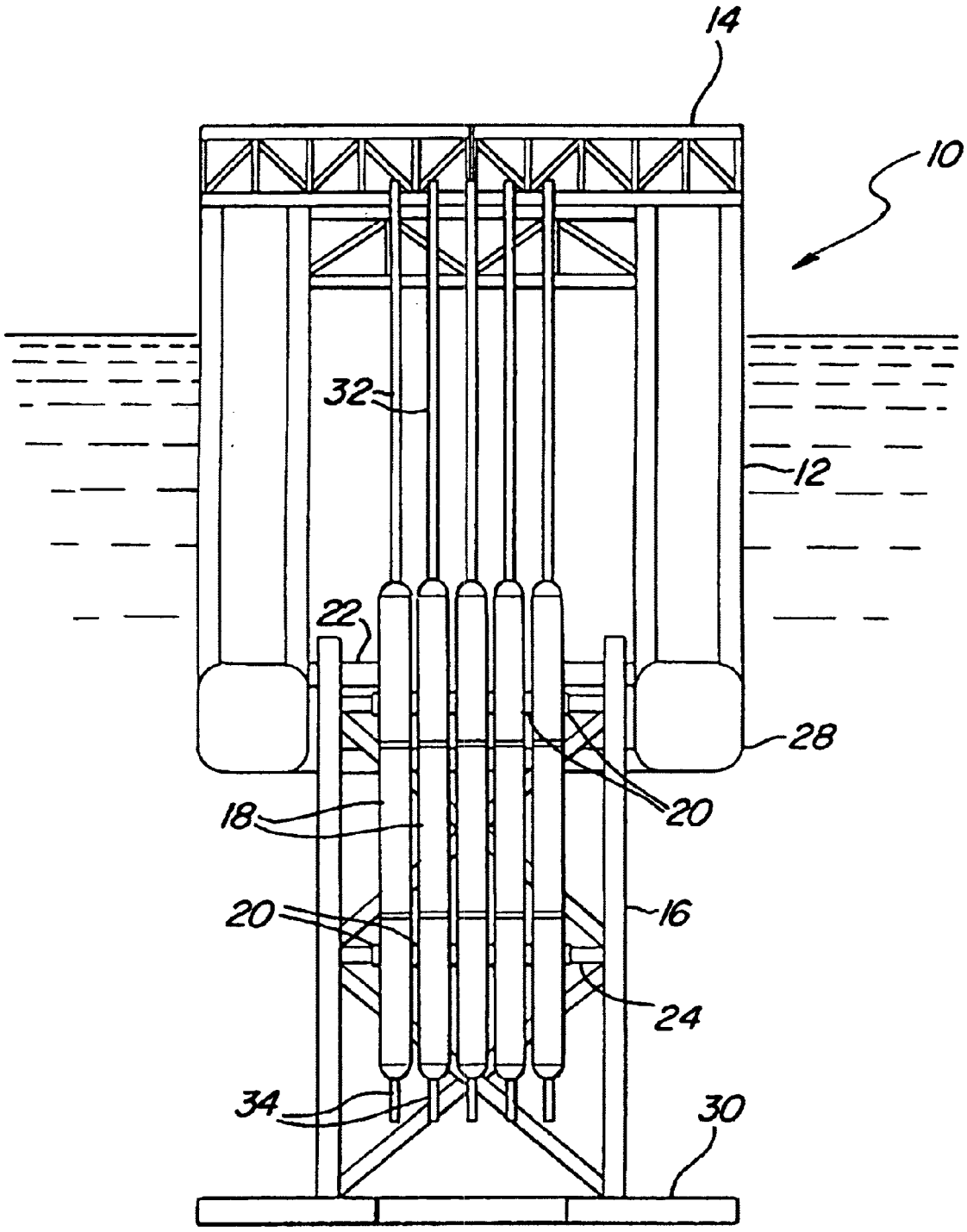
FIG. 5 illustrates the platform of FIG. 4 after it has been ballasted downward to the operating draft.

As seen in FIG. 4, air cans 18 are then lowered telescopingly into lowered truss 16. In this position, air cans 18 are again substantially caged by the truss 16. Compliant guides 20 laterally restrain air cans 18 as they are being lowered and in their final lowered position within truss 16. As air cans 18 are lowered, the upper stems 32 of air cans 18 are lengthened by adding pipe sections to their upper ends. As seen in FIG. 5, platform 10 is then ballasted downward to a relatively deeper, operating depth by flooding pontoons 28 with sea water.

In an alternative method of installation of the present invention, air cans 18 are lowered simultaneously with truss 16. As truss 16 and air cans 18 are lowered, the upper stems 32 of air cans 18 are lengthened by adding on pipe sections. Thus, the upper stem lengthening operation will be performed simultaneously with the truss and air can lowering operation.

Figure 6:
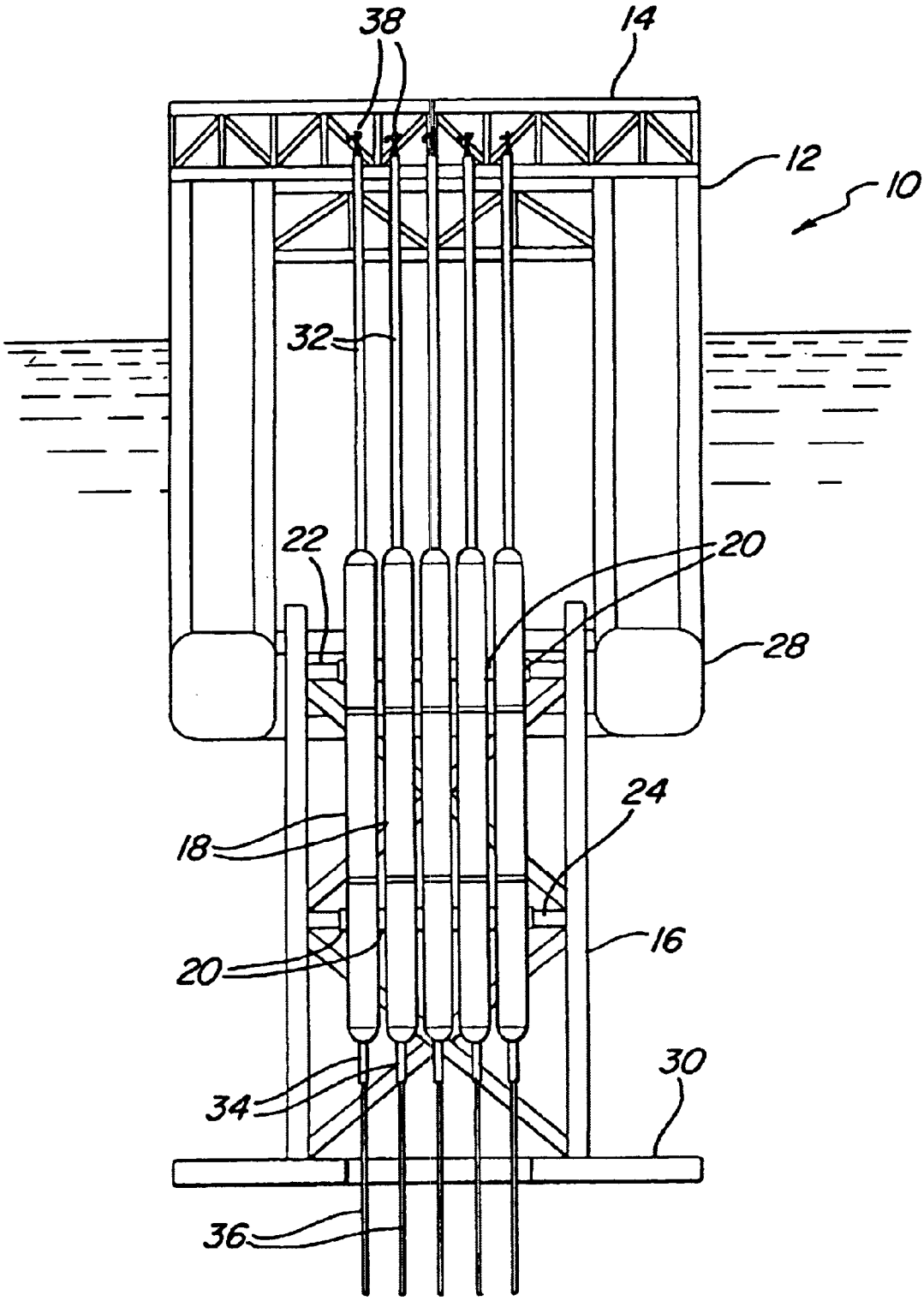
FIG. 6 illustrates the platform of FIG. 5 with risers installed through the air cans and production equipment installed at the riser tops.

As seen in FIG. 6, drilling or production risers 36 are then installed through upper stems 32, air cans 18, and lower stems 34 for connection to wells on the sea floor. Air cans 18 thus provide buoyancy to risers 36. Finally, production equipment 38 is installed on the upper ends of risers 36.

The telescoping truss platform of the present invention, and many of its intended advantages, will be understood from the foregoing description of an example embodiment, and it will be apparent that, although the invention and its advantages have been described in detail, various changes, substitutions, and alterations may be made in the manner, procedure, and details thereof without departing from the spirit and scope of the invention, as defined by the appended claims, or sacrificing all of its material advantages, the form hereinbefore described being exemplary embodiments thereof.

What is claimed is:

1. A method of installation of a floating, semi-submersible platform at a production location, the platform having a truss telescopingly mounted therein and having riser buoyancy members telescopingly received in the truss therein, the riser buoyancy members being laterally restrained by guides attached to the truss, the method comprising:

towing the platform to the production location at a relatively shallow, towing depth with the truss and riser buoyancy members in a raised position within the platform;

lowering the truss telescopingly to a lowered position extending below the platform, at least some of the guides laterally restraining the riser buoyancy members throughout the lowering process;

lowering the riser buoyancy members telescopingly into the lowered truss, at least some of the guides laterally restraining the riser buoyancy members throughout the lowering process;

ballasting down the platform to a relatively deeper operating depth; and installing risers through the riser buoyancy members for connection to wells on the sea floor.

2. The method of claim 1, wherein the riser buoyancy members are substantially caged by the truss when the truss and the riser buoyancy members are in their raised position within the platform.

3. The method of claim 1, wherein the riser buoyancy members are substantially caged by the truss when the truss and the riser buoyancy members are in their lowered position extending below the platform.

4. The method of claim 1, wherein the riser buoyancy members comprise air cans.

5. The method of claim 1, wherein the platform includes pontoons thereon, and wherein the platform is ballasted downward to a relatively deeper, operating depth by flooding the pontoons with sea water.

6. The method of claim 1, further including the step of installing production equipment on the upper ends of the risers.

* * * * *